US011142353B2

(12) United States Patent
Parietti et al.

(10) Patent No.: US 11,142,353 B2
(45) Date of Patent: Oct. 12, 2021

(54) AUTOMATED BATCH FILLING APPARATUS

(71) Applicant: Multiply Labs Inc., San Francisco, CA (US)

(72) Inventors: Federico Parietti, San Francisco, CA (US); Kameron C. Chan, San Francisco, CA (US); Alice Melocchi, Dalmine (IT); Lawrence Zachary Bright, San Francisco, CA (US); Jeffrey Ackerman Curhan, Warwick, RI (US)

(73) Assignee: Multiply Labs Inc., San Francisco, CA (US)

( * ) Notice: Subject to any disclaimer, the term of this patent is extended or adjusted under 35 U.S.C. 154(b) by 116 days.

(21) Appl. No.: 16/296,055

(22) Filed: Mar. 7, 2019

(65) Prior Publication Data

US 2019/0276165 A1 Sep. 12, 2019

Related U.S. Application Data

(60) Provisional application No. 62/639,807, filed on Mar. 7, 2018.

(51) Int. Cl.

| | |
|---|---|
| ***B65B 1/22*** | (2006.01) |
| ***B65B 1/36*** | (2006.01) |
| ***B65B 1/08*** | (2006.01) |

(52) U.S. Cl.

CPC ..... *B65B 1/22* (2013.01); *B65B 1/08* (2013.01); *B65B 1/36* (2013.01)

(58) Field of Classification Search

CPC .... B65B 1/08; B65B 1/22; B65B 1/36; B65B 37/04; B65B 37/20; A61J 3/074; A61J 3/075; Y10S 53/90

USPC ..... 53/900; 141/11, 12, 69, 71, 73, 74, 234, 141/237–240, 248

See application file for complete search history.

(56) References Cited

U.S. PATENT DOCUMENTS

| | | | | |
|---|---|---|---|---|
| 2,953,959 | A * | 9/1960 | Weinert | F42B 33/0292 141/73 |
| 3,324,902 | A * | 6/1967 | Lense | A61J 3/074 141/12 |
| 3,718,164 | A * | 2/1973 | Stewart | B65B 1/36 141/238 |
| 4,553,617 | A * | 11/1985 | Tatematsu | G01G 13/16 177/25.18 |
| 4,884,602 | A * | 12/1989 | Yamamoto et al. | B65B 1/36 141/238 |

(Continued)

FOREIGN PATENT DOCUMENTS

| | | | | |
|---|---|---|---|---|
| GB | 2177074 | A * | 1/1987 | B65B 5/103 |

*Primary Examiner* — Stephen F. Gerrity
(74) *Attorney, Agent, or Firm* — Morgan, Lewis & Bockius LLP

(57) ABSTRACT

An automated batch filling apparatus comprising a first base comprising a first plurality of metering holes, a trough slidably disposed on an upper surface of the first base, one or more guides configured to constrain a motion of the trough, a gate disposed on a bottom surface of the first base, wherein the gate comprises a second plurality of metering holes, a second base disposed below the gate, wherein the second base comprise a third plurality of metering hole, and one or more vibration devices, wherein the one or more vibration devices are configured to agitate the filling apparatus.

16 Claims, 9 Drawing Sheets

(56) References Cited

U.S. PATENT DOCUMENTS

| | | | | | |
|---|---|---|---|---|---|
| 5,143,126 | A * | 9/1992 | Boesch | A61K 9/1694 | 141/11 |
| 5,329,749 | A * | 7/1994 | Yamamoto et al. | A61J 3/074 | 53/900 |
| 5,406,990 | A * | 4/1995 | Haeberli | B65B 63/02 | 141/12 |
| 5,737,902 | A * | 4/1998 | Aylward | B65B 39/14 | 53/475 |
| 5,797,248 | A * | 8/1998 | Hetherington et al. | A61J 3/075 | 141/247 |
| 6,105,637 | A * | 8/2000 | VerMehren | B65B 1/06 | 141/129 |
| 7,234,494 | B2 * | 6/2007 | Tahil et al. | A61J 3/075 | 141/234 |
| 2010/0032058 | A1 * | 2/2010 | Lin | A61J 3/075 | 141/340 |

* cited by examiner

AUTOMATED BATCH FILLING APPARATUS

BACKGROUND OF THE INVENTION

Field of the Invention

The present disclosure relates to a filling apparatus. More particularly, the present disclosure relates to an automated batch filling apparatus.

Description of Related Art

In general, a batch filling apparatus is configured to fill a plurality of containers with a material en masse. Typically, the plurality of containers is a plurality of capsules, and the material to be filled therein is a powdered material. The filling of powders using conventional batch fillers incurs unique challenges that are imparted by the complexity of a flowing powdered material, and its inherent bulk density, as well as the manual procedures required to operate the filling apparatuses. For instance, flowing powders often inhibit non-uniform flow characteristics, which causes at least a material blockage or a buildup of material between various moving parts and in-between crevasses of the filling apparatus. These blockages require agitation of the device, agitation of the material, and/or agitation of the container in order to clear the blockages.

Another drawback of conventional batch fillers is a limiting fixed amount of material to be filled regardless of a size or shape of the container or filling material used therein. Typically, a capsule is disposed in a cavity and a volume of the capsule is the only limitation to the amount of material to be filled therein. Material is simply poured into the cavity, and an operator manually ensures that each cavity is filed to a desired amount. Such manual insurance involves employing a spatula and/or reorienting the device to allow the material to flow at a different angle or on a different surface. Such manual filling can lead to irregularities in packing conditions including an amount of material compression in the cavity, air bubbles or voids in the cavity, and the like. Conventional batch filling apparatuses also lack mechanism to be utilized for a single container with a plurality of materials while preventing cross-contamination between the plurality of materials.

Thus, prior to the present disclosure there existed a need for an improved automated batch filling apparatus. This is just one example of the many needs for improved automated batch filling apparatuses.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Advantageously, the automated batch filling apparatus detailed in the present disclosure address the shortcomings in the prior art detailed above.

Various aspects of the present disclosure are directed to providing automated batch filling apparatuses.

One aspect of the present disclosure provides an automated batch filling apparatus that includes a first base. The first base further includes a first plurality of metering holes. A trough is slidably disposed on an upper surface of the first base. One or more guides are configured to constrain a motion of the trough. A gate is disposed on a bottom surface of the first base. The gate includes a second plurality of metering holes. A second base is disposed below the gate. The second base includes a third plurality of metering holes. The apparatus includes one or more vibration devices. The one or more vibration devices are configured to agitate the filling apparatus.

In some embodiments, the second base is includes a main base that further includes the third plurality of metering holes and a plate is disposed on a bottom surface of the main base. The plate is configured to close a first end portion of each metering hole in the third plurality of metering holes.

In some embodiments, a volume is defined by each metering hole in the first plurality of metering holes. The volume defines a predetermined volume.

In some embodiments, the first plurality of metering holes, the second plurality of metering holes, and the third plurality of metering holes are each formed in an array of metering holes. The array of metering holes is selected from a rectangular array of metering holes or a circular array of metering holes.

In some embodiments, the sliding of the gate determines a filling state of the filling apparatus that is one of ON or OFF.

In some embodiments, the first plurality of metering holes, the second plurality of metering holes, and the third plurality of metering holes are aligned in the ON state. Thus, when the first plurality of metering holes and the second plurality of metering holes are unaligned in the OFF state.

In some embodiments, one or more support bars are disposed interposing between the first base and the second base.

In some embodiments, a mechanism to provide the motion of the trough is coupled to the trough.

In some embodiments, each motion of the trough dispenses a predetermined amount of material.

The automated batch filling apparatuses of the present invention have other features and advantages that will be apparent from, or are set forth in more detail in, the accompanying drawings, which are incorporated herein, and the following Detailed Description, which together serve to explain certain principles of exemplary embodiments of the present invention.

Figure 1:
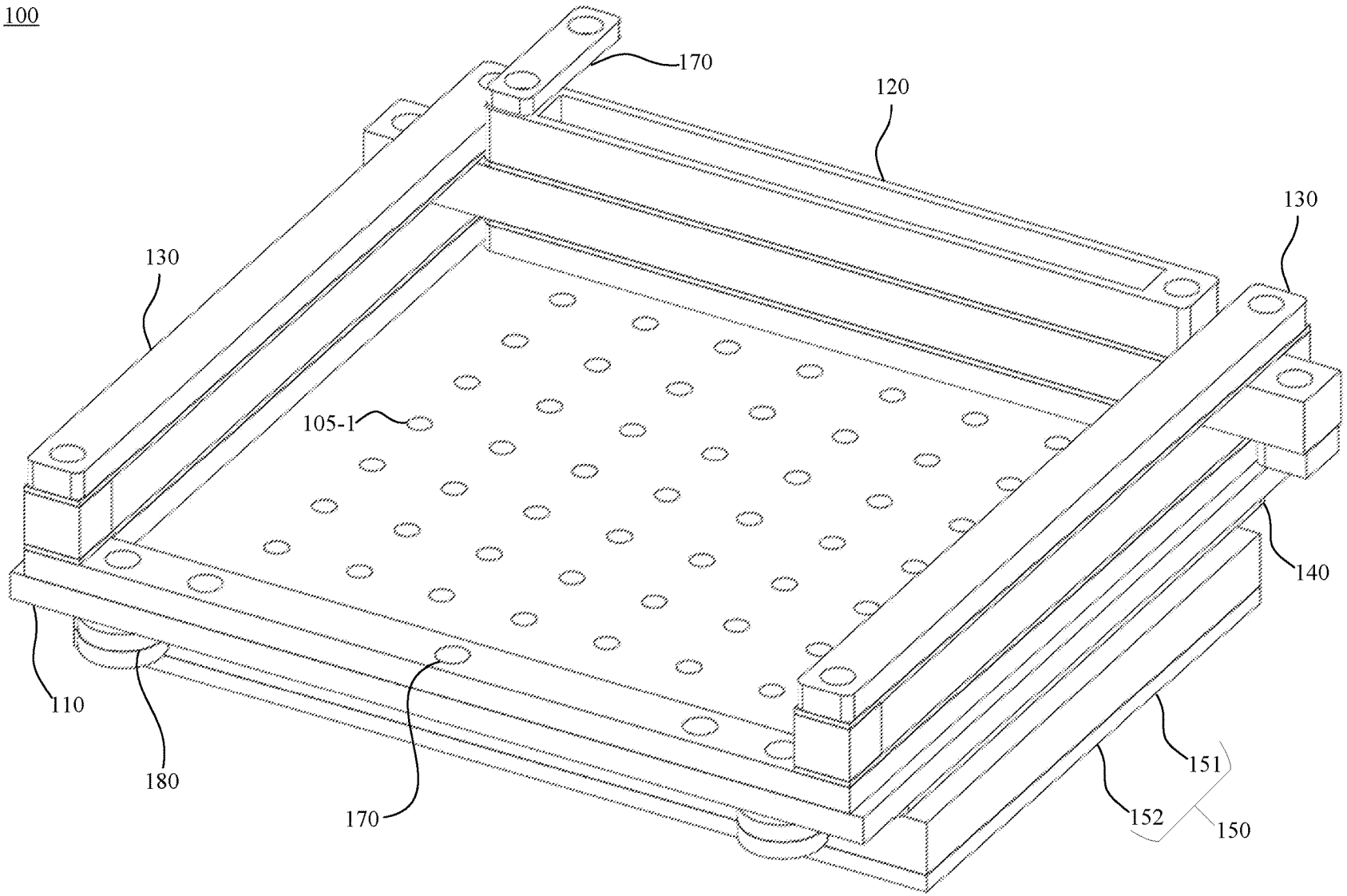
FIG. 1 is an isometric view of a filling apparatus in accordance with an exemplary embodiment of the present disclosure.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

It will also be understood that, although the terms first, second, etc. may be used herein to describe various elements, these elements should not be limited by these terms. These terms are only used to distinguish one element from another. For example, a first metering hole could be termed a second metering hole, and, similarly, a second metering hole could be termed a first metering hole, without departing from the scope of the present disclosure. The first metering hole and the second metering hole are both metering holes, but they are not the same metering hole.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

Various aspects of the present disclosure are directed to providing an automated batch filling apparatus. The filling apparatus of the present disclosure enables for any number of containers to be filled with one or more materials, which preferably includes at least a powdered material. Each container is accommodated by a corresponding series of holes disposed throughout the apparatus. A trough, which holds at least one of the one or more materials, moves along a surface of the apparatus, dispensing material throughout the motion of the trough. Furthermore, a vibration mechanism is configured to agitate at least a portion of the device to promote the dispensing of the material. Accordingly, the dispensed material fills each container.

One aspect of the present disclosure provides a filling apparatus that files a number of containers in a batch (e.g., fills the contains in an uninterrupted process). The filling apparatus includes a first base that further includes a first plurality of metering holes (e.g., through holes) disposed on a surface thereof. Each metering hole in the first plurality of metering holes is configured have a predetermine volume, which correlates to a predetermined dosage of a material. A trough is slidably disposed on an upper surface of the first base. The apparatus includes one or more guides configured to constrain a motion (e.g., sliding) of the trough, and a gate disposed on a bottom surface of the first base. The gate includes a second plurality of metering holes. A second base is disposed below the gate. The second base includes a third plurality of metering holes. Furthermore, the apparatus includes one or more vibration devices. The one or more vibration devices are configured to agitate the filling apparatus and promote a flow of material through the apparatus.

Referring now to FIGS. 1-5, there is depicted an exemplary automated batch filling apparatus in accordance with various embodiments of the present disclosure. As shown, apparatus 100 includes first base 110, which includes a first plurality of metering holes (e.g., first plurality of metering holes including metering hole 105-1) formed therethrough. The first plurality of metering holes is formed as through-holes that penetrate perpendicular to a surface of first base 110 (e.g., from an upper end portion to a lower end portion of the first base).

In the exemplary embodiments of the present disclosure, the first plurality of metering holes includes a square array of forty-nine metering holes 105-1 on a respective first base. However, the present disclosure is not limited thereto. For instance, in some embodiments each plurality of metering holes is formed in a rectangular array of metering holes or a circular array of metering holes. Typically, a number of metering holes in the plurality of metering holes is selected in accordance with a design of the present disclosure. For example, in some embodiments, each plurality of metering holes includes two metering holes. In some embodiments, each plurality of metering holes includes one hundred metering holes. In some embodiments, each plurality of metering holes includes one thousand metering holes. In many embodiments, a number of metering holes in each plurality of metering holes is limited by a size of the apparatus, a particle size of material, and a number of containers or cavities to be filled. In some embodiments, the plurality of metering holes (e.g., the first plurality of metering holes, the second plurality of metering holes, the third plurality of metering holes, etc.) is formed in a series of uniform columns and/or rows.

In some embodiments, a volume is defined by each metering hole in the first plurality of metering holes. This volume defines a predetermined volume as selected by a design of the present invention. In some embodiments, each metering hole in each respective plurality of metering holes has a same volume (e.g., each metering hole has a volume of 0.001 liters (L)). In some embodiments, each metering in each respective plurality of metering holes has one of a variety of predetermined sizes (e.g., each metering hole is one of 0.001 L, 0.002 L, or 0.003 L). In some embodiments, each row or column of metering holes in each respective plurality of metering holes has a same volume (e.g., each hole in a first row of metering holes has a first volume, each hole in a second row of metering holes has second volume, etc.). Nevertheless, in some embodiments each metering hole in the first plurality of metering holes is configured to have a volume of 0.01 milliliters (mL). In some embodiments, each metering hole in the first plurality of metering holes is configured to have a volume of 0.1 mL. In some embodiments, each metering hole in the first plurality of metering holes is configured to have a volume of 0.5 mL. In some embodiments, each metering hole in the first plurality of metering holes is configured to have a volume of 2.5 mL. An exact volume of each metering hole in the plurality of metering holes is determined by a design of the present invention (e.g., according to a desired dosage and/or density of material). In the present exemplary embodiments, only the first plurality of metering holes is utilized to determine an appropriate amount (e.g., dosage) of material to dispense, while the second plurality of metering holes and the third plurality of metering holes do not determine an appropriate amount of material. This determining is due to the fact that in one state of the apparatus, the first plurality of metering holes are exposed, allowing for material to flow from the trough through the respective hole, while a gate, or similarly unaligned second plurality of metering holes, prevents the material from flowing completely through the first plurality of metering holes. Thus, material fills each respective metering hole through the motion of the trough until the respective holes are completed filled, then the second plurality of metering holes are aligned with the first plurality of metering holes through the motion of the gate, allowing the material captured by the first plurality of metering holes to flow through the apparatus. However, the present disclosure is not limited thereto. For instance, in some embodiments the first plurality of metering holes and the second plurality of metering holes are utilized to determine an appropriate amount of material to dispense.

As briefly described above, trough 120 is slidably disposed on an upper surface of first base 110 and configured to accommodate a material therein. Trough 120 is formed with at least an open bottom end portion that allows material to escape from the trough, as well as an open upper end portion that allows for loading of the material into the trough. In some embodiments the upper end portion of the trough includes a cover to prevent contamination of the material stored in the trough. Thus, as trough 120 slides over the upper surface of first base 110, which includes first plurality of metering holes 105-1, material is deposited from the trough into the first plurality of metering holes. Preferably, the trough has a size (e.g., a length and/or a width) that is sufficient to span each hole in the first plurality of metering holes through a single motion of the trough. In some embodiments, the motion of the trough includes the trough traversing from one end portion of the apparatus to a second end portion of the apparatus (e.g., each portion of the trough traverses the apparatus. However, the present disclosure is not limited thereto. For instance, in some embodiments a first end portion of the trough is fixed to a surface of the first base and a second end portion of the through trough is slidable about the first base. Thus, the motion of the trough is a rotation about the first end portion of the through.

Nevertheless, in some embodiments the trough includes one or more tapered (e.g., chamfered, sloped, filleted, etc.) surface to assist depositing (e.g., a flow) and/or collecting of material. For instance, in some embodiments one or more internal walls (e.g., a wall of the trough in surface contact with a material accommodated by the trough) of the trough includes a tapered surface. In some embodiments, one or more external walls (e.g., a wall of the trough opposite an internal wall of the trough) of the trough includes a tapered surface, which allows for excess material dispensed during the motion of the trough to be collected by the tapered surface of the external walls. In some embodiments, the trough is formed with a predetermined volume. In some embodiments, the predetermined volume of the through trough is greater than or equal to the combined volumes of each hole in the first plurality of metering holes (e.g., the trough is configured to accommodate a sufficient volume of material to fill each hole in the first plurality of metering holes). In some embodiments, the motion of the trough is provided by a mechanism (e.g., a pneumatic cylinder, a robotic arm, etc.). In some embodiments, the mechanism includes a controller.

In some embodiments, the open bottom end portion of the trough is formed with a gate. In such embodiments, the gate is selectively opened or closed to allow the flow of material from the trough to each respective hole in the first plurality of metering holes. In some embodiments, the trough is a hopper or a funnel. In some embodiments, a stirrer is disposed inside the trough and configured to agitate and/or feed material into the first plurality of metering holes. In some embodiments, the trough is compartmentalized into a plurality of compartments such that each compartment of the trough is configured to accommodate a different material.

In some embodiments, the apparatus includes one or more guides 130, which are configured to constrain the motion of the trough, disposed on a surface of the apparatus. In the present exemplary embodiment, two linear guides 130 are disposed on the upper surface of first base 110 and configured to limit the motion of trough 120 to one degree of freedom. However, the present disclosure is not limited thereto. In some embodiments, the one or more guides are configured to limit the motion of the trough to two degrees of freedom. Furthermore, in some embodiments the one or more guides are disposed on a side surface of the apparatus (e.g., a side surface of the first base). In some embodiments, the one or more guides are selected from the group consisting of ball bearing slides, compound slides, dovetail slides, roller slides, rack slides, or a combination thereof. In some embodiments, the one or more guides include one or more bearings that is configured to minimize friction between the trough, the first base, and the one or more guides during the motion of the trough. Furthermore, in some embodiments the one or more guides are configured as a spacer in order to configure a distance between the first base and the trough. For instance, in some embodiments the one or more guides are configured to either form a gap between the first base and the trough or prevent a gap from forming there between.

Figure 7:
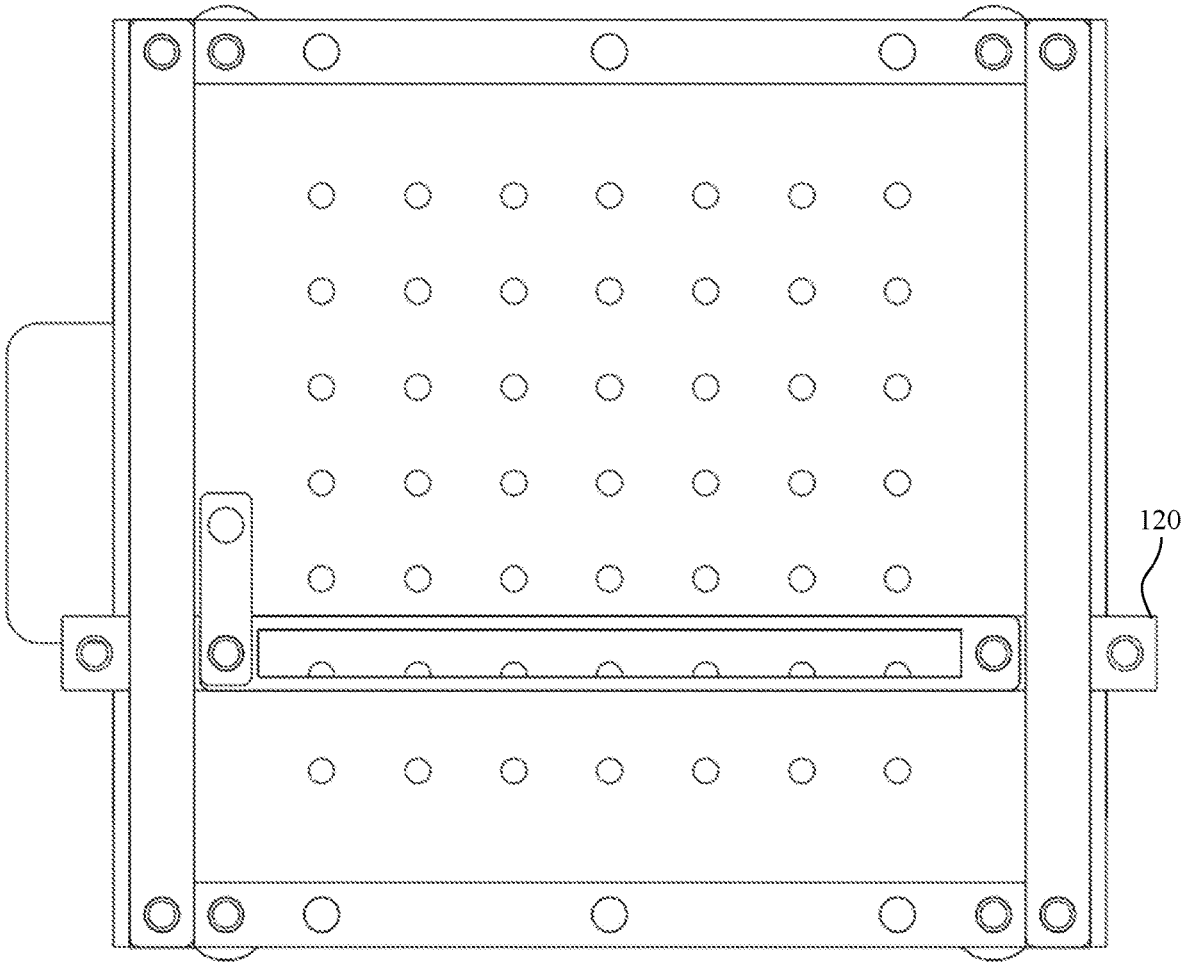
FIG. 7 is a view of a top view of a filling apparatus in accordance with an exemplary embodiment of the present disclosure.

Referring to FIG. 7, a motion of trough 120 is exemplified. In the present exemplary embodiment, the motion of the trough 120 is a linear sliding motion. Thus, during the motion the trough traverse from a first end portion of the apparatus to a second end portion of the apparatus. First plurality of metering holes 105-1 is disposed in-between the first end portion of the apparatus and the second end portion of the apparatus, and are thus filled during the motion of the trough. As used herein, a "motion" of the trough is defined as portion of the trough traversing from the first end portion of the apparatus to the second end portion of the apparatus.

Figure 2:
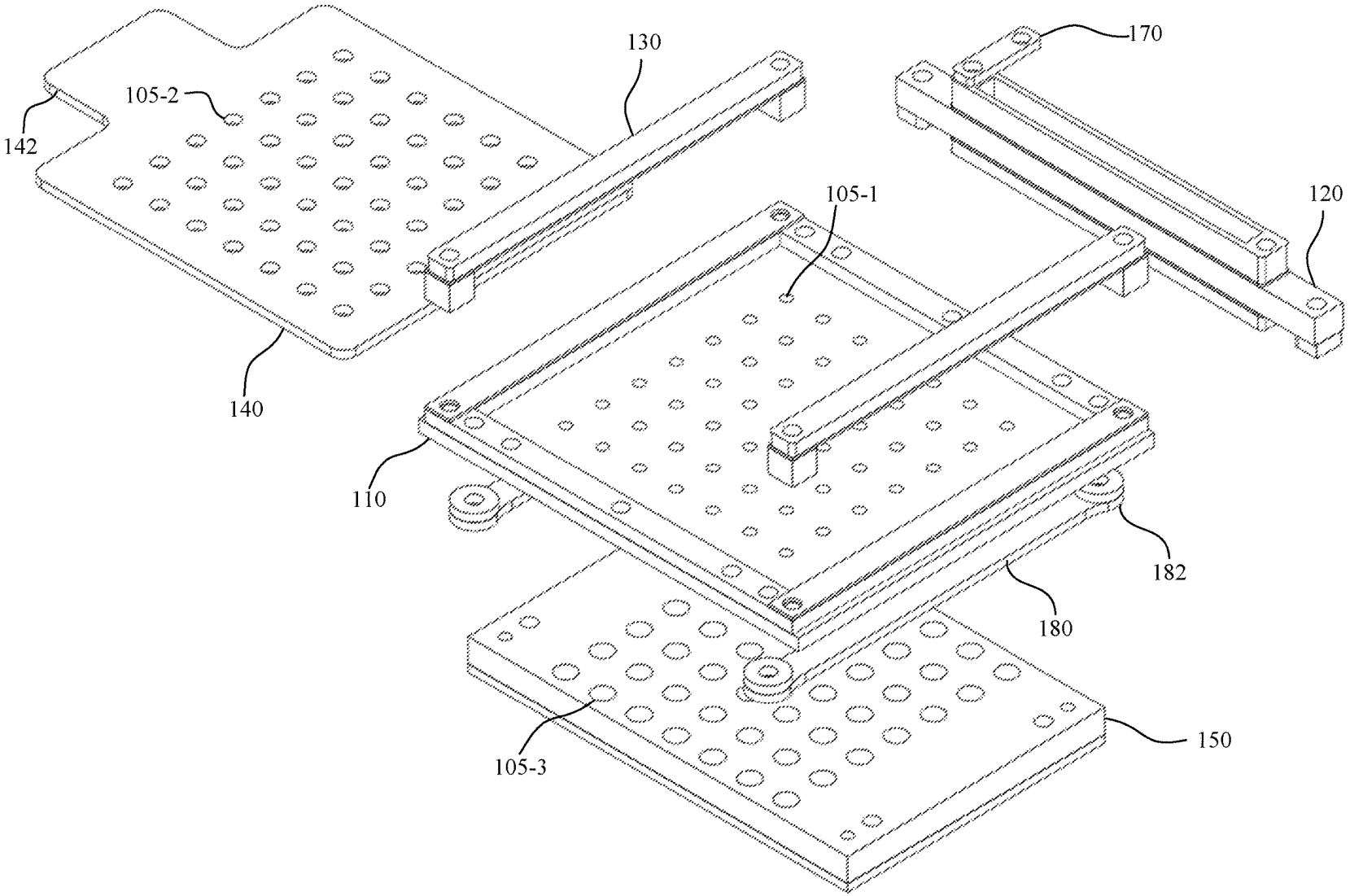
FIG. 2 is an exploded view of a filling apparatus in accordance with an exemplary embodiment of the present disclosure.
Figure 3:
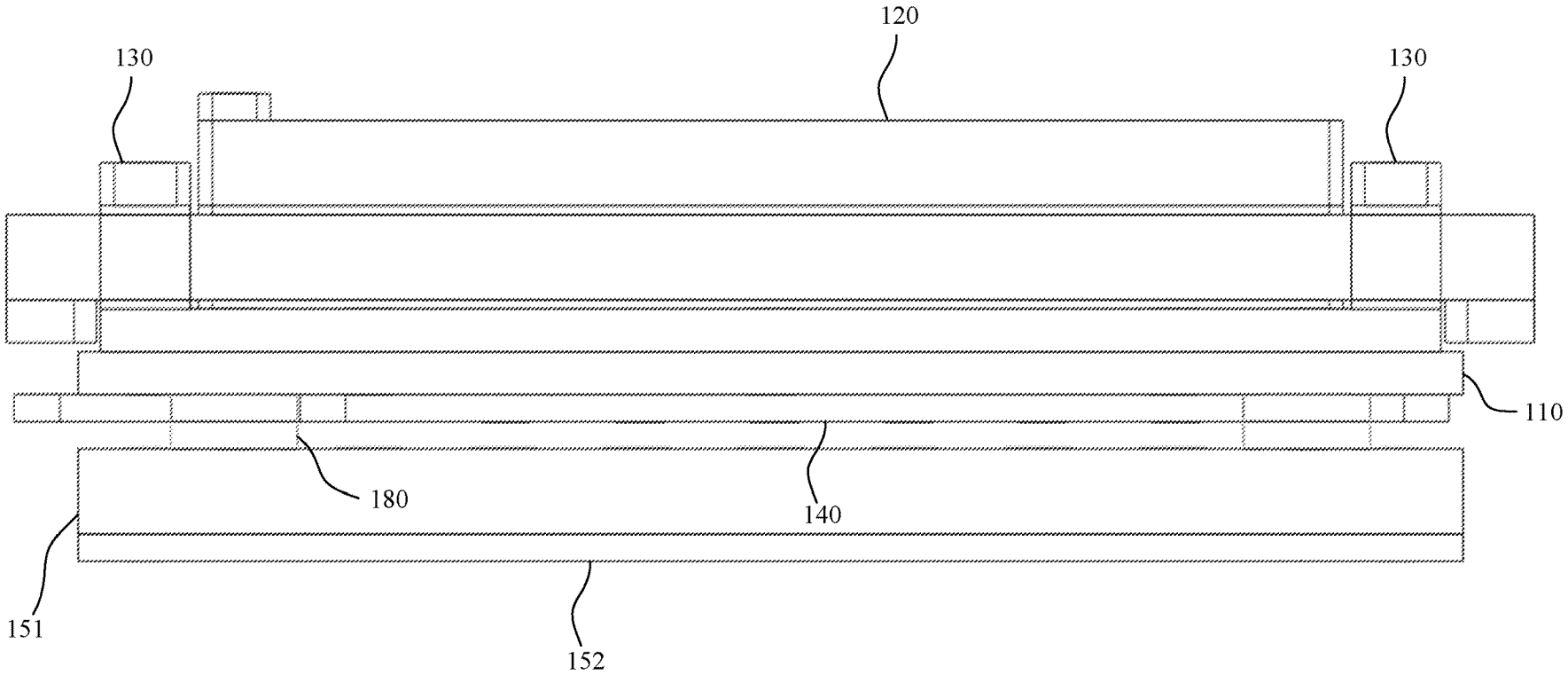
FIG. 3 is a front view of a filling apparatus in accordance with an exemplary embodiment of the present disclosure.
Figure 4:
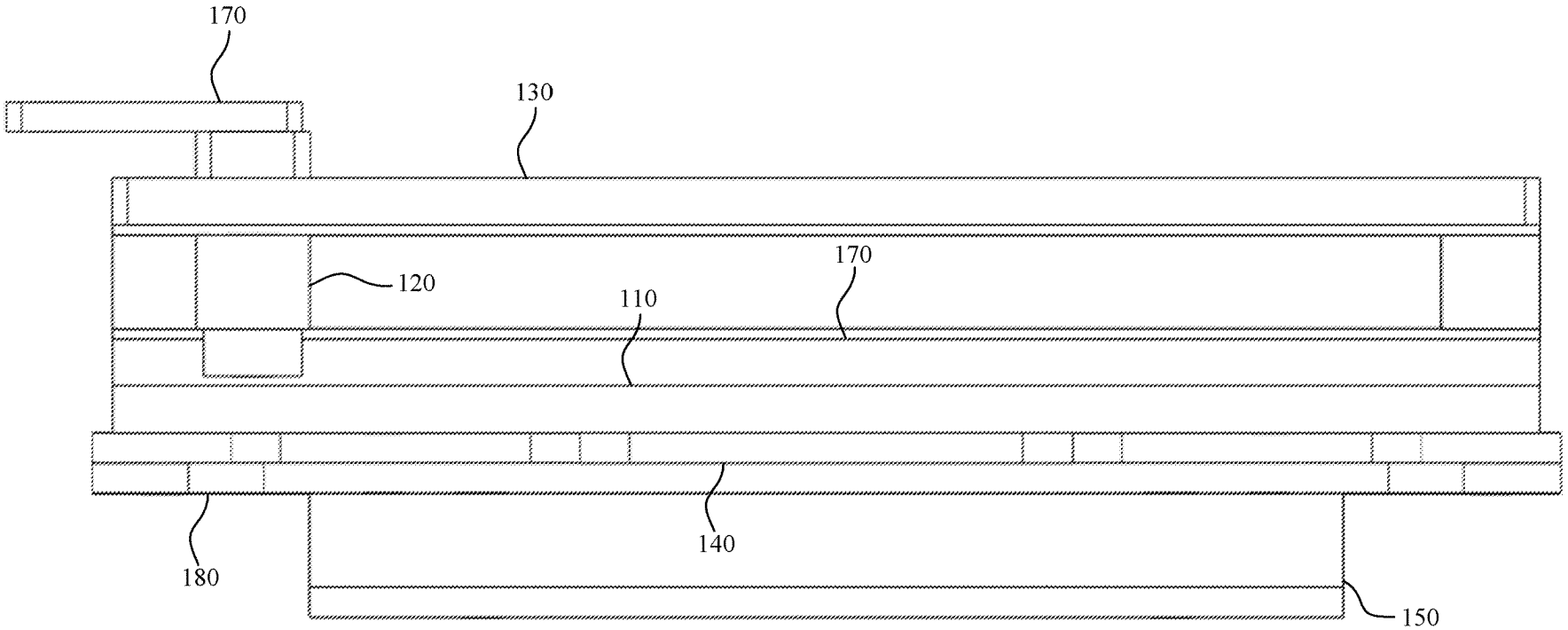
FIG. 4 is a side view of a filling apparatus in accordance with an exemplary embodiment of the present disclosure.
Figure 5:
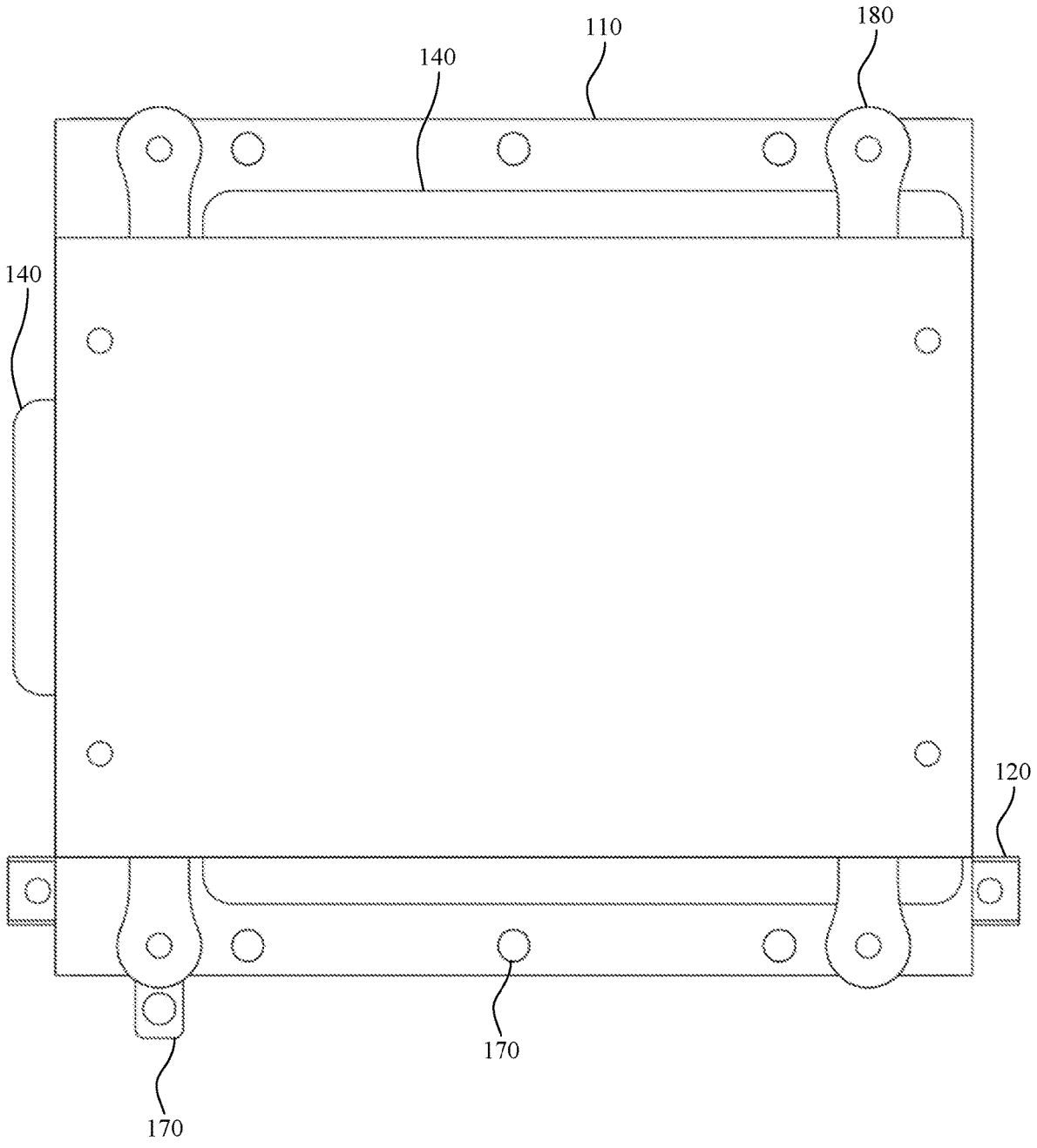
FIG. 5 is a bottom view of a filling apparatus in accordance with an exemplary embodiment of the present disclosure.

Referring back to FIGS. 1-5, gate 140 is disposed on a bottom surface of first base 110. As shown in FIG. 2, gate 140 includes a plurality of metering holes (e.g., second plurality of metering holes 105-2). In some embodiments, the second plurality of metering holes includes through holes that, optionally, do not have metering functionality regarding an amount of material to be fed. As previously described, in some embodiments for each metering hole in the first plurality of metering holes there exists at least one corresponding metering hole in the second plurality of metering holes. In some embodiments, a diameter of each metering hole in the second plurality of metering holes is the same as a diameter of each metering hole in the first plurality of metering holes. However, the present disclosure is not limited thereto. For instance, in some embodiments a diameter of each metering hole in the second plurality of metering holes is greater than a corresponding diameter of a corresponding metering hole in the first plurality of metering holes. This greater diameter of the second plurality of metering holes allows for material to flow from the first plurality of metering holes to the second plurality of metering holes with a reduced risk of having the first and second metering holes be unaligned. Furthermore, in some embodiments a diameter of each respective metering hole in the second plurality of metering holes is less than a distance between adjacent metering holes in the first plurality of metering holes. This configuration prevents a portion of a hole in the second plurality of metering holes from aligning with a hole in the first plurality of metering holes when the gate is in a CLOSED or OFF state. In some embodiments, a position of the gate determines a state of the filling apparatus, which will be described in more detail infra. In some embodiments, an end portion of the gate (e.g., end portion 142) is configured to be grasped and/or integrated with a mechanism to provide motion of the gate, including, but not limited to, a robotic arm, a conveyer belt, a track system, and the like. In such embodiments, the gate is automatically moved from an OPEN state to a CLOSED state in accordance with commands received via a controller.

The apparatus includes second base 150 disposed below gate 140. The second base includes a plurality of metering holes (e.g., third plurality of metering holes 105-3). In some embodiments, the third plurality of metering holes 105-3 is configured to hold a plurality of containers (e.g., pharmaceutical capsules). As previously described, in some embodiments the third plurality of metering holes is simple through holes and do not have metering functionality regarding an amount of material to be fed. Nevertheless, each hole in the third plurality of metering holes is configured to accommodate a respective container in an orientation that allows for the respective container to receiving material disposed by the trough (e.g., a vertical orientation). In some embodiments, a height of each hole in the third plurality of metering holes is equal to a height of a respective container held by the hole. In some embodiments, a height of each hole in the third plurality of metering holes is greater than a height of a respective container held by the hole. In some embodiments, a diameter of each hole in the third plurality of metering holes is approximately equal to a diameter of a container held therein.

In some embodiments, second base 150 includes main base 151 and plate 152. In such embodiments, main base 151 includes third plurality of metering holes 105-3 and plate 152 is configured to block an end portion of the third plurality of metering holes. Thus, in some embodiments where the plate is removably disposed on the main base, the contents of the third plurality of metering holes can be removed from the main base without dismantling at least a portion of the apparatus.

In some embodiments, one or more support bars 180 are disposed interposing first base 110 and second base 150. Support bars 180 are configured to assist the motion of the gate. A number, a size, and a type of the support bars may vary in accordance with a design of the present disclosure. In some embodiments, each support bar includes one or more bumpers 182 that is configured to assist the motion of the gate. In some embodiments, the support bars are a point of dismantling for the assembly. For instance, from the support bars an upper portion of the apparatus that includes the first base, the trough, the guides, the gate, or a combination thereof can be removed to expose an upper surface of the second base. Likewise, a lower portion of the apparatus that includes the second base can be removed to expose a lower surface of the gate and/or the first base. In general, components of the filling apparatus of the present disclosure can be removed and replaced with a similar component without interfering with other components of the filling apparatus, allowing the apparatus to be easily cleaned and maintained depending on which materials are being utilized. For instance, a first material can be utilized by a first upper portion of the apparatus (e.g., a first set of a first base, a trough, . . . , etc.) while a second material can be utilized by a second upper portion of the apparatus (e.g., a second set of a first base, a trough, . . . , etc.) using the same gate and/or second base. This allows for a container accommodated by the third plurality of metering holes to remain therein while being filled by different materials as described above.

In some embodiments, a gap is formed between various moving members or members adjacent to a moving member. In such embodiments, a height of the gap is configured so that the clearance between components is sufficiently large to prevent galling yet sufficiently small to prevent the material from entering the gap. Such gaps can exist between, but are not limited to, the trough and the first base, the first base and the gate, the gate and the support bars, the gate and the second base, or a combination thereof.

In the exemplary embodiments of the apparatus, the plurality of metering holes is formed perpendicular to a planar surface of the apparatus. However, the present invention is not limited thereto. In some embodiments, each plurality of metering holes in the plurality of metering holes is formed at a predetermined angle to a planar surface of the apparatus. Similarly, in the exemplary embodiments of the apparatus, the plurality of metering holes is formed as a plurality of cylindrical holes; however, the present invention is not limited thereto. In some embodiments, the first plurality of metering holes is formed in a plurality of frustums or funnels.

Figure 6C:
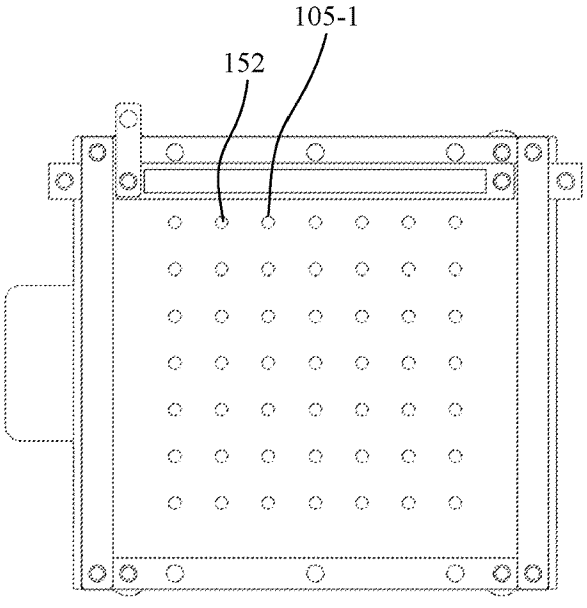
FIG. 6A, FIG. 6B, and FIG. 6C are views depicting a closed configuration of a gate, a transitional configuration of the gate, and an open configuration of the gate respectively in accordance with an exemplary embodiment of the present disclosure.
Figure 6B:
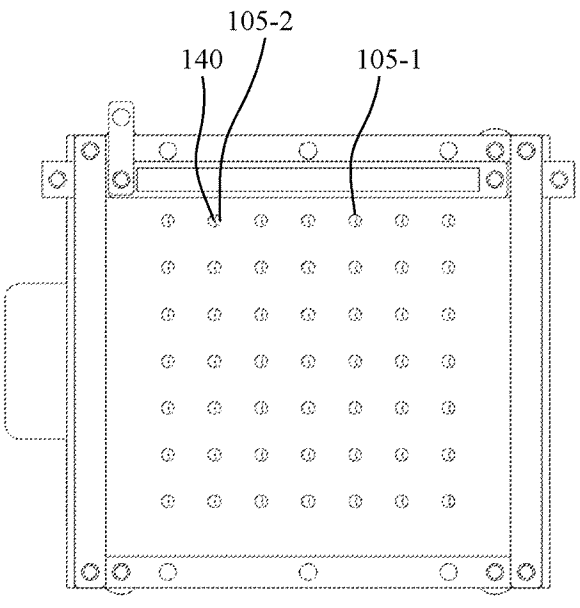
Figure 6A:
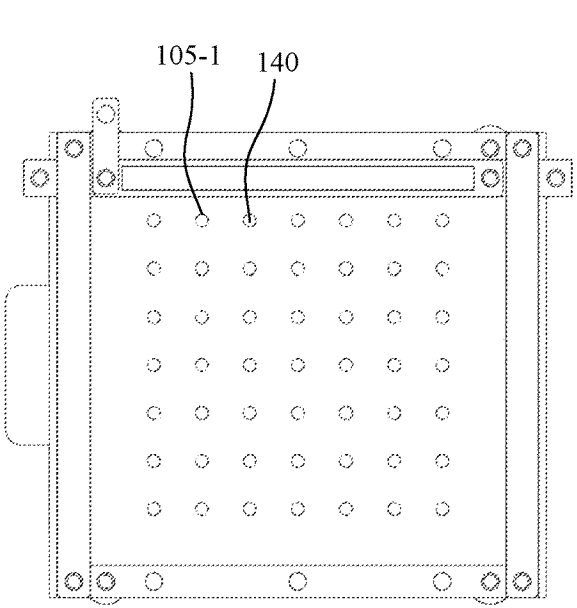

Referring to FIGS. 6A-6C, in some embodiments an alignment of each of the plurality of metering holes determines the state of the apparatus. For instance, referring to FIG. 6A, when a filling state of the apparatus is OFF, gate 140 is positioned such that second plurality of metering holes 105-2 do not align with first plurality of metering holes 105-1. Thus, during the motion of trough 120, material fills the volume(s) of the first plurality of metering holes, but the material is prevented from escaping the first plurality of metering holes by the gate. Referring to FIG. 6B, once filling of the first plurality of metering holes 105-1 is completed, the gate 140 is moved from a closed position to an open position. As shown in FIG. 6B, during this transitional state, a partially through-hole is formed from the first plurality of metering holes 105-1 to the third plurality of metering holes 105-3 by way of the second plurality of metering holes 105-2. Referring to FIG. 6C, when the gate 140 is in the open position, material is free to flow from the first plurality of metering holes 105-1 to the third plurality of metering holes 105-3 by way of the second plurality of metering holes 105-2 unobstructed. In the present exemplary embodiments, the gate is drawn outwardly, away from the first base, in order to change the filling state of the apparatus. However, the present disclosure is not limited thereto. In some embodiments, the gate is drawn inwardly, towards the first base, in order to change the filling state of the apparatus. In some embodiments, the gate is rotated in order to change the filling state of the apparatus.

In some embodiments, throughout the processes of FIGS. 6A-6C, one or more vibration devices of the present disclosure is configured to be selectively activated. Activation of the one or more vibration devices depends on a material to be fed to a container accommodated by the third plurality of metering holes, as well as a design of the present disclosure. For instance, within a design of the present disclosure an amplitude, a frequency, a duration, an intensity, or a combination thereof can be optimized for each vibration device in the one or more vibration devices. For instance, in some embodiments one vibration device in the one or more vibration devices is optimized to dislodge material stuck in the plurality of metering holes, whereas another vibration device in the one or more vibration devices is optimized to smooth the motion of the trough. Furthermore, in some embodiments the one or more vibration devices are pre-optimized in accordance with a predetermined material such that a frequency and amplitude of the one or more vibration defines is specific to the material. In some embodiments, a first vibration device in the one or more vibration devices is configured for a first material and a second vibration device in the one or more vibration devices is configured for a second material that is different than the first material. In some embodiments, configurations of the one or more vibration devices are altered depending on a desired material to be fed. In the figures, mounts 170 are shown where vibration devices may be disposed on the apparatus. For instance, in some embodiments a first vibration device is coupled to the trough (e.g., via a corresponding mount). In some embodiments, a second vibration device is coupled to the first base. An exact disposal location of mounts 170 and/or vibrations devices can be chosen in accordance with a design of the present invention. In general, the one or more vibration devices of the present disclosure can be disposed on a variety of locations of the apparatus, so long as the vibration devices do not interfere with at least the motions of the trough and/or the gate.

In some embodiments, a mechanism that provides the motion of the trough and/or the gate vary greatly in accordance with various implementations and embodiments of the present invention. For instance, in some embodiments the mechanism to provide the motion to the trough and/or the gate includes a human operator (e.g., the trough and/or the gate are at least partially manually operated). In some embodiments, the mechanism that provides the motion to the trough and/or the gate includes one or more actuators. In some embodiments, the mechanism to provide the motion to the trough and/or the gate includes a robotic arm, a belt including, but not limited to, a conveyer belt, or a motor. In accordance with various aspects of the present invention, a goal of the exemplary embodiments is to fully automate the operation of the filling apparatus. Thus, all motions and their related components are configured to be conducted with an automated device via commands received from a controller.

Figure 8A:
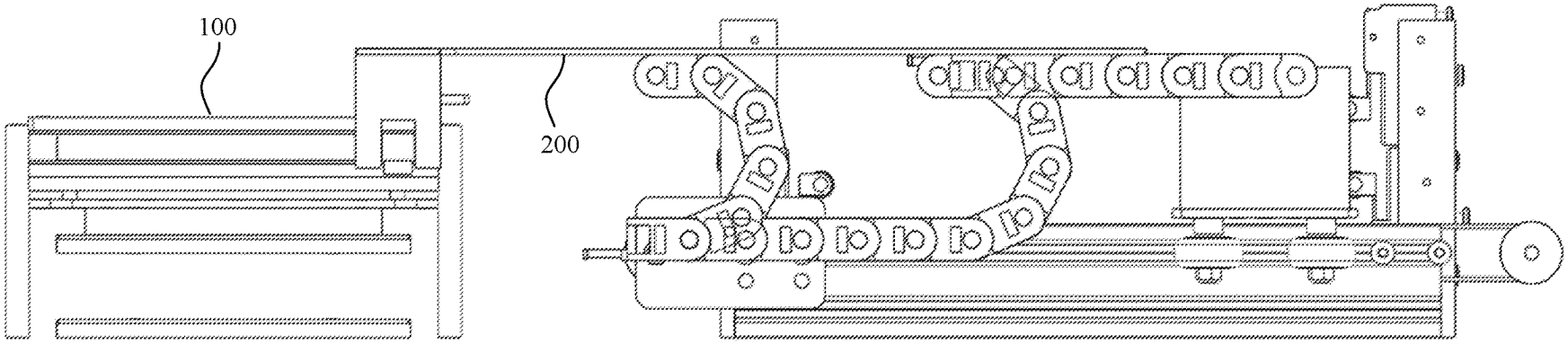
FIG. 8A and FIG. 8B are views of a filling apparatus and system in accordance with an exemplary embodiment of the present disclosure.
Figure 8B:
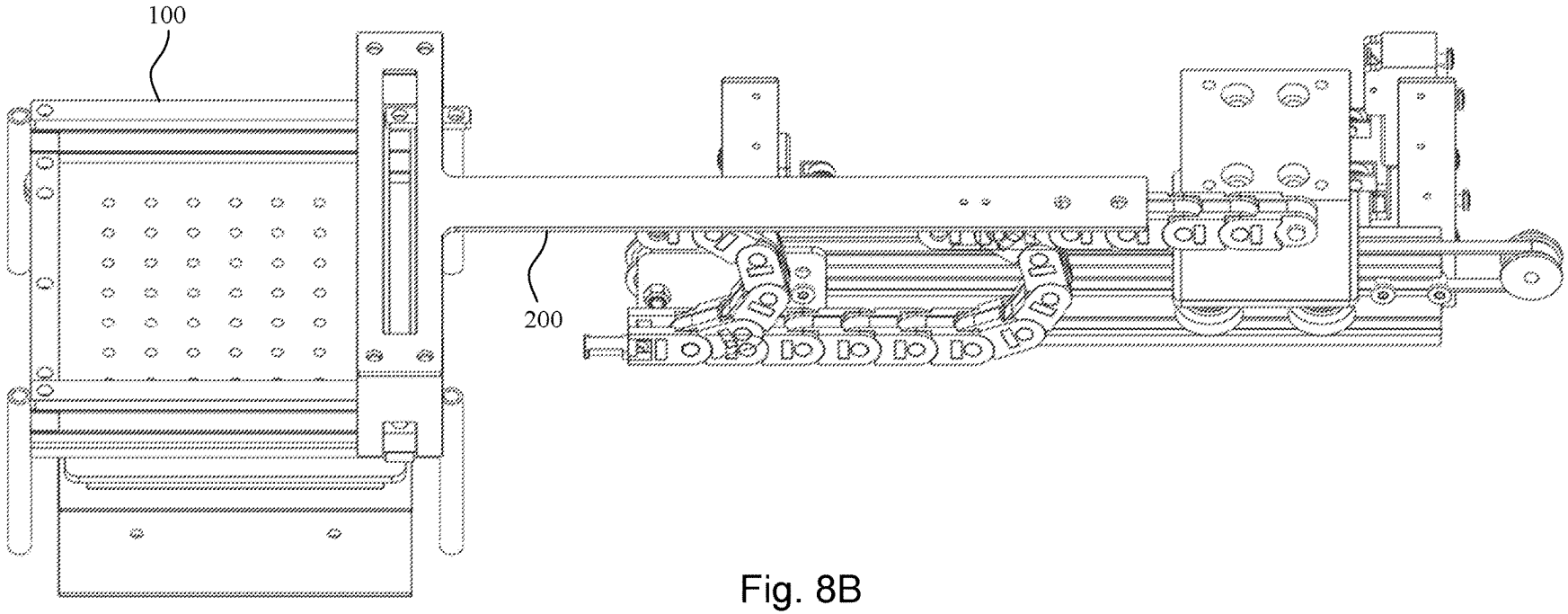

Referring to FIG. 8, an exemplary mechanism (e.g., mechanism 200) to provide the motion of the trough is illustrated. In the present exemplary embodiment, the apparatus 100 is coupled to an actuator 200, that provides the motion of the trough.

Figure 9:
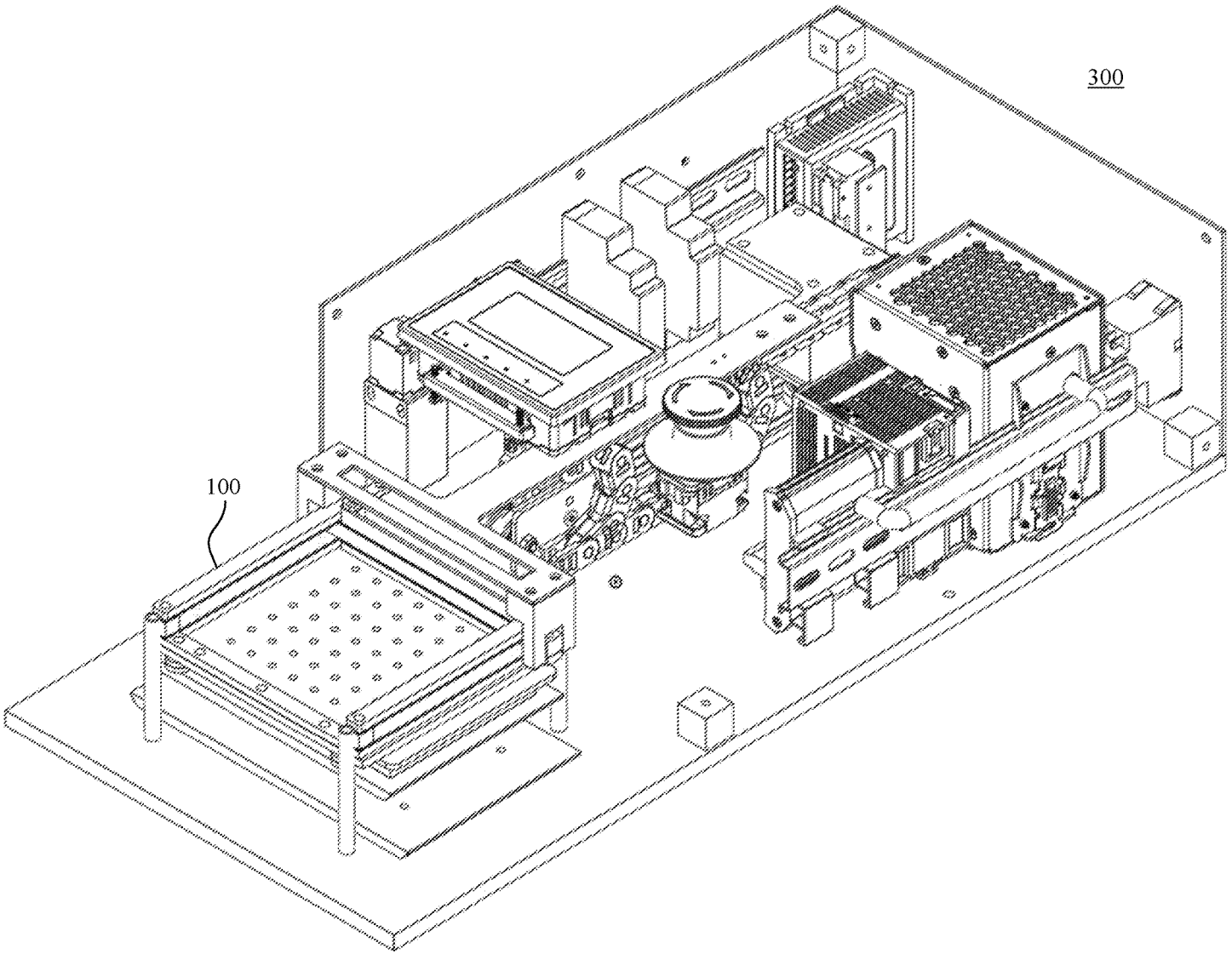
FIG. 9 is a view of a filling apparatus and system in accordance with an exemplary embodiment of the present disclosure.

Referring to FIG. 9, in some embodiments, filling apparatus 100 is a component of a larger automated system 300. In such embodiments, the filling apparatus seamlessly integrates with the automated system in accordance with a design of the present invention. For instance, in the present embodiment, the automatic system is accommodated in a first clean room environment, as defined by walls in the figure, while the apparatus is accommodated in a second clean room environment separate from the first clean room environment. As used herein a "clean room environment" refers to a region isolated from an external environment. In some embodiments, the automatic system and the apparatus are accommodated in a first clean room environment. In some embodiments, the mechanism and controllers of the apparatus are stored in the clean room environment 300. As previously described, in some embodiments operations of the filling apparatus of the present invention can be fully automated including, but not limited to, the motion of the trough, the activation of the one or more vibrating devices, and the motion of the gate. In further embodiments, the supplying of containers to the third plurality of metering holes and the loading of material to the trough are also automated in accordance with a design of the present invention.

EXAMPLE I

Filling a Plurality of Containers with a First Material and a Second Material In this example, processes for filling a plurality of containers with at least two distinct materials will be described in accordance with an embodiment of the present disclosure.

A plurality of containers is disposed in the third plurality of metering holes. An initial material is selected in accordance with a design of the present disclosure and an initial first base is selected in accordance with the first material. The initial first base includes an initial first plurality of metering holes. Each hole in the initial first plurality of metering holes has a predetermined volume defined by the initial material and the design of the present invention. An initial trough is loaded with the initial material. Motion of the trough is then initiated, and one or more vibrating devices are activated to promote flow of the initial material into the initial first plurality of metering holes. Once the initial first plurality of metering holes is filled, the motion of the trough is ceased and the gate is switched from an OFF position to an ON position, thus allowing the initial material to flow from the initial first plurality of metering holes to the containers in the third plurality of metering holes by way of a second plurality of metering holes in the gate. One or more vibration devices remain/are activated to promote the flow of initial material, but cease when filling of the initial material has completed.

A second material is selected in accordance with the design of the present invention, and another first base is selected in accordance with the second material. The other first base includes another first plurality of metering holes, where each hole in the other first plurality of metering holes has a predetermined volume defined by the second material and the design of the present invention. A second trough is loaded with the second material. Motion of the second trough is then initiated, and one or more vibrating devices are activated to promote flow of the second material into the other first plurality of metering holes. Once the other first plurality of metering holes is filled, the motion of the second trough is ceased and the gate is switched from the OFF position to the ON position, thus allowing the second material to flow from the other first plurality of metering holes to the containers in the third plurality of metering holes by way of the second plurality of metering holes in the gate. One or more vibration devices remain/are activated to promote the flow of the second material, but cease when filling of the second material has completed. Thus, the containers in the third plurality of metering holes can be filled with at least two discrete materials while avoiding cross-contamination of the at least two discrete materials.

In some embodiments, the initial first base and the initial trough are thoroughly cleaned then reused instead of the other first base and the second trough. Thus, in accordance with various aspects of the present invention, modularity of the filling apparatus is achieved. In the apparatus, the first base, the trough, the gate, and the second base are configured to be easily replaceable to prevent excessive cleaning and/or cross-contamination.

For convenience in explanation and accurate definition in the appended claims, the terms "upper", "lower", "up", "down", "upwards", "downwards", "inner", "outer", "inside", "outside", "inwardly", "outwardly", "interior", "exterior", "front", "rear", "back", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An automated batch filling apparatus comprising:

a first base comprising a first plurality of metering holes;

a trough configured to accommodate one or more materials, wherein the trough is slidably disposed on an upper surface of the first base, and wherein the trough comprises an opening at a bottom end portion of the trough extending from a first end portion of the trough to a second end portion of the trough;

one or more guides configured to constrain a motion of the trough;

a gate disposed on a bottom surface of the first base, wherein the gate comprises a second plurality of metering holes;

a second base disposed below the gate, wherein the second base comprise a third plurality of metering hole; and one or more vibration devices, wherein the one or more vibration devices are configured to agitate the filling apparatus.

2. The filling apparatus of claim 1, wherein the second base is comprised of:

a main base comprising the third plurality of metering holes; and a plate disposed on a bottom surface of the main base, wherein the plate is configured to close a first end portion of each metering hole in the third plurality of metering holes.

3. The filling apparatus of claim 1, wherein a volume defined by each metering hole in the first plurality of metering holes is a predetermined volume.

4. The filling apparatus of claim 1, wherein the first plurality of metering holes, the second plurality of metering holes, and the third plurality of metering holes are each formed in an array of metering holes.

5. The filling apparatus of claim 4, wherein the array of metering holes is a circular array.

6. The filling apparatus of claim 4, wherein the array of metering holes is a rectangular array.

7. The filling apparatus of claim 4, wherein a size of the opening is greater than or equal to a length of the array of metering holes.

8. The filling apparatus of claim 1, wherein the sliding of the gate determines a filling state of the filling apparatus that is one of ON or OFF.

9. The filling apparatus of claim 8, wherein:

the first plurality of metering holes, the second plurality of metering holes, and the third plurality of metering holes are aligned in the ON state; and the first plurality of metering holes and the second plurality of metering holes are unaligned in the OFF state.

10. The filling apparatus of claim 1, wherein one or more support bars are disposed interposing between the first base and the second base.

11. The filling apparatus of claim 1, wherein a mechanism to provide the motion of the trough is coupled to the trough.

12. The filling apparatus of claim 1, wherein each motion of the trough dispenses a predetermined amount of material.

13. The filling apparatus of claim 1, wherein an internal wall of the trough comprises a tapered surface.

14. The filling apparatus of claim 1, wherein the gate is removably disposed on the bottom surface of the first base.

15. The filling apparatus of claim 1, wherein the sliding of the gate is perpendicular to a motion of the trough.

16. The filling apparatus of claim 1, wherein an external wall of the trough comprises a tapered surface.

* * * * *